US007908979B2

(12) United States Patent
Yoshida et al.

(10) Patent No.: US 7,908,979 B2
(45) Date of Patent: Mar. 22, 2011

(54) PALLET HAVING LOAD BEARING CAPABILITIES ON WHICH ARTICLES MAY BE PLACED FOR STORAGE AND/OR TRANSPORTATION

(75) Inventors: Zane Yoshida, Yeronga (AU); Rene Roger Lloyd Doel, Helensvale (AU); Chee Cheang Lee, Penang (MY)

(73) Assignee: Aeropal Technology SDN. BHD, Penang (MY)

( * ) Notice: Subject to any disclaimer, the term of this patent is extended or adjusted under 35 U.S.C. 154(b) by 319 days.

(21) Appl. No.: 12/094,031

(22) PCT Filed: Nov. 17, 2006

(86) PCT No.: PCT/AU2006/001734

§ 371 (c)(1),
(2), (4) Date: May 16, 2008

(87) PCT Pub. No.: WO2007/056821

PCT Pub. Date: May 24, 2007

(65) Prior Publication Data

US 2008/0295748 A1 Dec. 4, 2008

(30) Foreign Application Priority Data

Nov. 17, 2005 (AU) ..... 2005906379

(51) Int. Cl.
*B65D 19/38* (2006.01)

(52) U.S. Cl. ..... 108/57.25; 108/57.27

(58) Field of Classification Search ..... 108/57.25, 108/51.11, 56.3, 57.27, 57.28, 901, 902; 248/346.02; 206/386, 599, 600
See application file for complete search history.

(56) References Cited

U.S. PATENT DOCUMENTS 3,511,191 A * 5/1970 Verdi et al. ..... 108/901
3,581,681 A * 6/1971 Newton ..... 108/901
3,719,157 A 3/1973 Arcocha et al.
3,720,176 A * 3/1973 Munroe ..... 108/57.25

(Continued)

FOREIGN PATENT DOCUMENTS

DE 2045712 9/1970

(Continued)

OTHER PUBLICATIONS

International Search Report from the corresponding PCT/AU2006/001734, mailed Feb. 6, 2007.

(Continued)

*Primary Examiner* — José V Chen
(74) *Attorney, Agent, or Firm* — Hamre, Schumann, Mueller & Larson, P.C.

(57) ABSTRACT

A pallet includes a platform, having a substantially rectangular shape and is generally flat, an upper side face and an opposing underside face, and a plurality of supports that depend from said underside face. The supports are arranged in rows that extend both transversely and longitudinally across the surface of the underside face. The supports and the underside face are preferably covered by a generally rectangular shaped bottom sheet made, for example, of high impact polystyrene (HIPS) or high-density polyethylene (HDPE). A top sheet covers at least some of the upper side face. The supports are interconnected by a plurality of bridges that are spaced from the underside of the platform and which are adapted to provide support for the pallet when at least some of said bridges rest upon frame members of a rack.

25 Claims, 12 Drawing Sheets

U.S. PATENT DOCUMENTS

| | | | | |
|---|---|---|---|---|
| 3,880,092 | A | 4/1975 | Seeber et al. | |
| 4,051,787 | A * | 10/1977 | Nishitani et al. | 108/901 |
| 4,735,154 | A * | 4/1988 | Hemery | 108/56.1 |
| 5,117,762 | A * | 6/1992 | Shuert | 108/57.25 |
| 5,595,125 | A | 1/1997 | Bridges, Jr. | |
| 5,687,652 | A * | 11/1997 | Ruma | 108/57.25 |
| 5,778,801 | A * | 7/1998 | Delacour | 108/57.25 |
| 5,791,262 | A * | 8/1998 | Knight et al. | 108/57.25 |
| 5,868,080 | A * | 2/1999 | Wyler et al. | 108/57.25 |
| 6,173,657 | B1 * | 1/2001 | Espejo | 108/51.11 |
| 6,250,234 | B1 * | 6/2001 | Apps | 108/57.25 |
| 6,305,301 | B1 * | 10/2001 | Piper et al. | 108/57.25 |
| 6,357,366 | B1 * | 3/2002 | Frankenberg | 108/57.25 |
| 6,622,642 | B2 * | 9/2003 | Ohanesian | 108/57.25 |
| 6,718,888 | B2 * | 4/2004 | Muirhead | 108/57.25 |
| 6,758,148 | B2 * | 7/2004 | Torrey et al. | 108/51.11 |
| 6,786,992 | B2 | 9/2004 | Dummett | |
| 6,874,428 | B2 * | 4/2005 | Apps | 108/57.25 |
| 6,962,115 | B2 * | 11/2005 | Markling et al. | 108/57.25 |
| 6,986,309 | B2 * | 1/2006 | Sugihara et al. | 108/57.25 |
| 7,308,857 | B2 * | 12/2007 | Moore et al. | 108/51.11 |
| 7,690,315 | B2 * | 4/2010 | Apps | 108/901 |
| 2003/0110990 | A1 * | 6/2003 | Apps | 108/57.25 |
| 2005/0211139 | A1 * | 9/2005 | Perrotta et al. | 108/57.25 |
| 2005/0263044 | A1 | 12/2005 | Bearse et al. | |
| 2008/0141912 | A1 * | 6/2008 | Valentinsson | 108/57.25 |

FOREIGN PATENT DOCUMENTS

| | | |
|---|---|---|
| DE | 2045712 | 3/1972 |
| GB | 2 357 275 | 6/2001 |
| WO | WO 01/64526 | 9/2001 |

OTHER PUBLICATIONS

A Chinese Office Action dated Aug. 21, 2009 for corresponding Chinese Patent Application No. 200680043133.0.

* cited by examiner

PALLET HAVING LOAD BEARING CAPABILITIES ON WHICH ARTICLES MAY BE PLACED FOR STORAGE AND/OR TRANSPORTATION

BACKGROUND OF THE INVENTION

This invention relates to a pallet.

This invention has particular, but not exclusive, application to a pallet that is used as a moveable platform on which goods are placed for storage and/or transportation, including handling using a forklift truck. However, it will be appreciated that this invention may also be used in the construction of a base for various types of packaging to be used for storage and/or transportation of goods, including containers and creates.

Pallets typically include a platform and a plurality of dependent supports that are capable of supporting the platform above a foundation or a structure, such as a rack, upon which the pallet rests. Further both the arrangement of the supports and the space separating the platform and the foundation upon which it rests are typically sufficient to allow a forklift tine to be located there between.

It will be appreciated that the cost of a consumer item is dependent upon many factors including the cost of packaging, transportation and storage of the item.

Pallets, being a load bearing structure, have traditionally been manufactured from heavy and expensive materials, such as timber and steel. Whereas once there was an abundance of timber and pallets and other forms of packaging made from timber were viewed as throwaway items, timber has in recent years become a scarce resource. As a consequence the cost of timber, and therefore pallets, has increased in recent years.

Further, in an effort to prevent the transfer of unwanted pests and diseases from one country to another, some countries will only permit the importation of goods made of materials that are known to be good carriers of pests and diseases, such as timber, if they have been chemically treated. Accordingly, in order to comply with the customs requirements of many countries, pallets made from timber must be fumigated, which adds to the costs associated with the transportation and storage of consumer items.

Typically freight charges are dependent upon the combined weight of the article and any associated packaging. Accordingly, it is desirous that any packaging, including pallets, used for the transportation of goods be made from light weight materials, such as various plastics materials.

In highly competitive markets, such as those relating to the sale of electronic goods and "white" goods, where margins are small, savings relating to the cost of transportation and storage of items are most desirous.

In an effort to overcome the problems associated with pallets made of timber, various vacuum formed pallets having a core made from expanded polystyrene encapsulated by an external skin made from a thermoplastics material have been developed and are currently being used. However, the inventors are not aware of either a two way entry and/or a four way entry, rackable, vacuum formed, pallet.

SUMMARY OF THE INVENTION

It is an object of the present invention to provide a pallet that ameliorates at least some of the deficiencies of the prior art and/or a two way entry, vacuum formed, pallet that is rackable, and/or a four way entry, vacuum formed, pallet that is rackable, and/or a stronger vacuum formed pallet, and/or a vacuum formed pallet that is more economical to produce, and/or a vacuum formed pallet that is more durable.

With the foregoing in view, this invention in one aspect relates to a rackable pallet having load bearing capabilities on which one or more articles may be placed for storage and/or transportation, including:

a body having a platform that includes an upper side face upon which the article or articles may rest and a plurality of supports that depend from an underside face of said platform, said supports being adapted to provide support for said platform and to space said platform above a foundation or a structure on which the pallet rests, said body being constructed from predominantly one or more light weight materials having no or little inherent load bearing capacity;

an external skin that is bonded to and envelopes the underside face of said platform and said supports and at least some of the upper side face of said platform, and a plurality of bridges that extend between adjacent supports, said bridges being spaced from the underside of said platform and adapted to provide support for the pallet when at least some of said bridges rest upon frame members of a rack, and whereby in use a forklift having a plurality of tines may be used to move the pallet and wherein each tine may be locatable between adjacent supports and/or between the underside of said platform and one or more bridges.

In another aspect, this invention relates to a pallet having load bearing capabilities on which one or more articles may be placed for storage and/or transportation, including:

a body having a platform that includes an upper side face upon which the article or articles may rest and a plurality of supports that depend from an underside face of said platform, said supports being adapted to provide support for said platform and to space said platform above a foundation or a structure on which the pallet rests, said body being constructed from predominantly one or more light weight materials having no or little inherent load bearing capacity;

an external skin that is bonded to and envelopes the underside face of said platform and said supports and at least some of the upper side face of said platform, and a plurality of wear resistant members that are affixed to an underside of at least some of said supports and which are adapted in use to bear against a foundation upon which the pallet rests.

Preferably the pallet is a rackable pallet and wherein the wear resistant members are bridges that extend between adjacent supports, said bridges being spaced from the underside of said platform and are adapted to provide support for the pallet when at least some of said bridges rest upon frame members of a rack.

In still yet another aspect, this invention relates to a pallet having load bearing capabilities on which one or more articles may be placed for storage and/or transportation, including:

a body having a platform that includes an upper side face upon which the article or articles may rest and a plurality of supports that depend from an underside face of said platform, said supports being adapted to provide support for said platform and to space said platform above a foundation or a structure on which the pallet rests, said body being constructed from predominantly one or more light weight materials having no or little inherent load bearing capacity;

an external skin that is bonded to and envelopes the underside face of said platform and said supports and at least some of the upper side face of said platform, and a plurality of surface projections that depend from a lower face of at least some of said supports, said projections being adapted to engage a foundation, such as a conveyor.

Preferably the engagement of the projections with the foundation is an interlocking engagement.

Preferably, the pallet includes one or more foundation engaging members and wherein the surface projections are associated with said foundation engaging member or said foundation engaging members, and wherein the foundation engaging member or each foundation engaging member is attached to one or more supports. Further, it is preferred that the pallet is a rackable pallet and wherein the foundation engaging members are bridges that extend between adjacent supports, said bridges being spaced from the underside of said platform and are adapted to provide support for the pallet when at least some of said bridges rest upon frame members of a rack.

The platform may be any suitable shape. However, in the preferred form of the invention the platform has a substantially square shape when viewed in plan.

The upper side face of the platform may include at least one groove or channel formed therein that is adapted to receive a lower edge portion of a structural member or a side wall used in the construction of a package that is adapted to surround one or more articles to be stored and/or transported on said pallet.

The supports are preferably arranged in rows such that a forklift tine is locatable between adjacent rows of supports. Further, it is preferred that the supports are arranged in longitudinally and transverse extending rows thus forming either a two way entry pallet or a four way entry pallet.

The body may be constructed from a variety of light weight materials including cardboard, particle board, cellulosic fibre cement timber, various plastics materials and other porous or air permeable substances. However in the preferred embodiment the body is constructed from expanded polystyrene (EPS) and wherein the platform and the supports are formed integrally using a suitable moulding process.

It is believed that the density of the expanded polystyrene used in the construction of the body will influence the strength of the pallet. In particular it is believed that the greater the density of the expanded polystyrene the greater the strength of the pallet.

Further, it is believed that the extent to which the expanded beads used in the construction of the body fuse together also influences the strength of the pallet.

It is also believed that the strength of the pallet is influenced by the extent to which the external skin bonds with the body. In particular it is believed that the greater the surface area of the external skin that is bonded to the body the greater the strength of the pallet.

During the vacuum forming process, the heated skin is urged into contact with the body. In order that the heated skin may fuse with the body, preferably as much air or other gas trapped between the skin and the body is removed and wherein the extent to which the skin fuses with the body is influenced by the ability of the vacuum forming process to remove these gases.

However, increasing the density of the expanded polystyrene used in the construction of the body will also inhibit the flow of air through the body during the vacuum forming process. To counter this, a plurality of cavities and/or openings are formed in the body. These preferably extend between the upper side of the platform and the underside of the platform and/or between the upper side of the platform and the underside of the supports.

In the preferred embodiment, the expanded polystyrene has a density in the order of 28 kg/m3, and wherein the degree of fusion preferably is equal to or greater than 70%.

It is also preferred that there are provided a plurality of openings or cavities formed in the platform having a diameter of approximately 3 mm, said openings being located between the supports. In the preferred embodiment the openings extend between the underside face and a point located just below the upper side face.

The material from which the skin is made may include one or more of the following materials: acrylonitrile butadiene styrene; polyester; styrene; polycarbonate; PET; APET; PETG; lead free PVC; copolymer polyester/polycarbonate; and HDPE.

Preferably the external skin includes a bottom sheet that covers the supports and the underside face of the platform and a top sheet that covers the upper side face of the platform.

In the preferred embodiment, the external skin is manufactured from high impact polystyrene, (HIPS), or a composite HIPS structure and wherein the top sheet is approximately 0.6 mm thick and the bottom sheet is 1.2 mm thick.

It is also believed that the ability of the supports to resist compressive loads is greatly enhanced if each of the side walls includes a plurality of generally longitudinally extending ribs.

The bridges may be manufactured from any suitable material. For example, the bridges may be constructed from wood, metal and/or various plastics materials, including lead free PVC. However, in the preferred embodiment, the bridges are manufactured from HIPS using an extrusion forming process.

Further, the bridges may be configured so that they each span two or more supports of a row and are preferably affixed to the end walls of each of said supports so that they interconnect same. For example, the bridges may be affixed to abutting end walls using a suitable adhesive.

In still yet another aspect, this invention relates to a pallet formed using a vacuum forming process, said pallet having load bearing capabilities and on which one or more articles may be placed for storage and/or transportation, said pallet including:

a body having a platform that includes an upper side face upon which the article or articles may rest and a plurality of supports that depend from an underside face of said platform, said supports being adapted to provide support for said platform and to space said platform above a foundation or a structure on which the pallet rests, said body being constructed from expanded polystyrene, and an external skin that is bonded to and envelopes the underside face of said platform and said supports and at least some of the upper side face of said platform, characterized in that there are formed a plurality of cavities and/or openings in said body. These cavities and/or openings preferably extend between the upper side of the platform and the underside of the platform and/or between the upper side of the platform and the underside of the supports.

Preferably the pallet is a rackable pallet and wherein the pallet also includes a plurality of bridges that extend between adjacent supports, said bridges being spaced from the underside of the platform and adapted to provide support for the pallet when at least some of said bridges rest upon frame members of a rack, and whereby in use a forklift having a plurality of tines may be used to move the pallet and wherein each tine may be locatable between adjacent supports and/or between the underside of said platform and one or more of said bridges.

In still yet another aspect, this invention relates to a pallet formed using a vacuum forming process, said pallet having load bearing capabilities and on which one or more articles may be placed for storage and/or transportation, said pallet including:

a body having a platform that includes an upper side face upon which the article or articles may rest and a plurality of supports that depend from an underside face of said platform, said supports being adapted to provide support for said platform and to space said platform above a foundation or a structure on which the pallet rests, said body being constructed from expanded polystyrene, and an external skin that is bonded to and envelopes the underside face of said platform and said supports and at least some of the upper side face of said platform, characterised in that each of said supports includes a plurality of side walls located between the underside of said platform and an end wall of said support and wherein all of said side walls of at least some of said supports include a plurality of ribs that extend between the underside of said platform and said end wall.

Preferably the pallet is a rackable pallet and wherein the pallet also includes a plurality of bridges that extend between adjacent supports, said bridges being spaced from the underside of the platform and adapted to provide support for the pallet when at least some of said bridges rest upon frame members of a rack, and whereby in use a forklift having a plurality of tines may be used to move the pallet and wherein each tine may be locatable between adjacent supports and/or between the underside of said platform and one or more of said bridges.

BRIEF DESCRIPTION OF THE DRAWINGS

In order that the invention may be more easily understood and put into practical effect, reference will now be made to the accompanying drawings which illustrate a preferred embodiment of the invention and wherein:—

FIGS. 1 to 6 show a pallet 10 that is constructed in accordance with the present invention.

Figure 1:
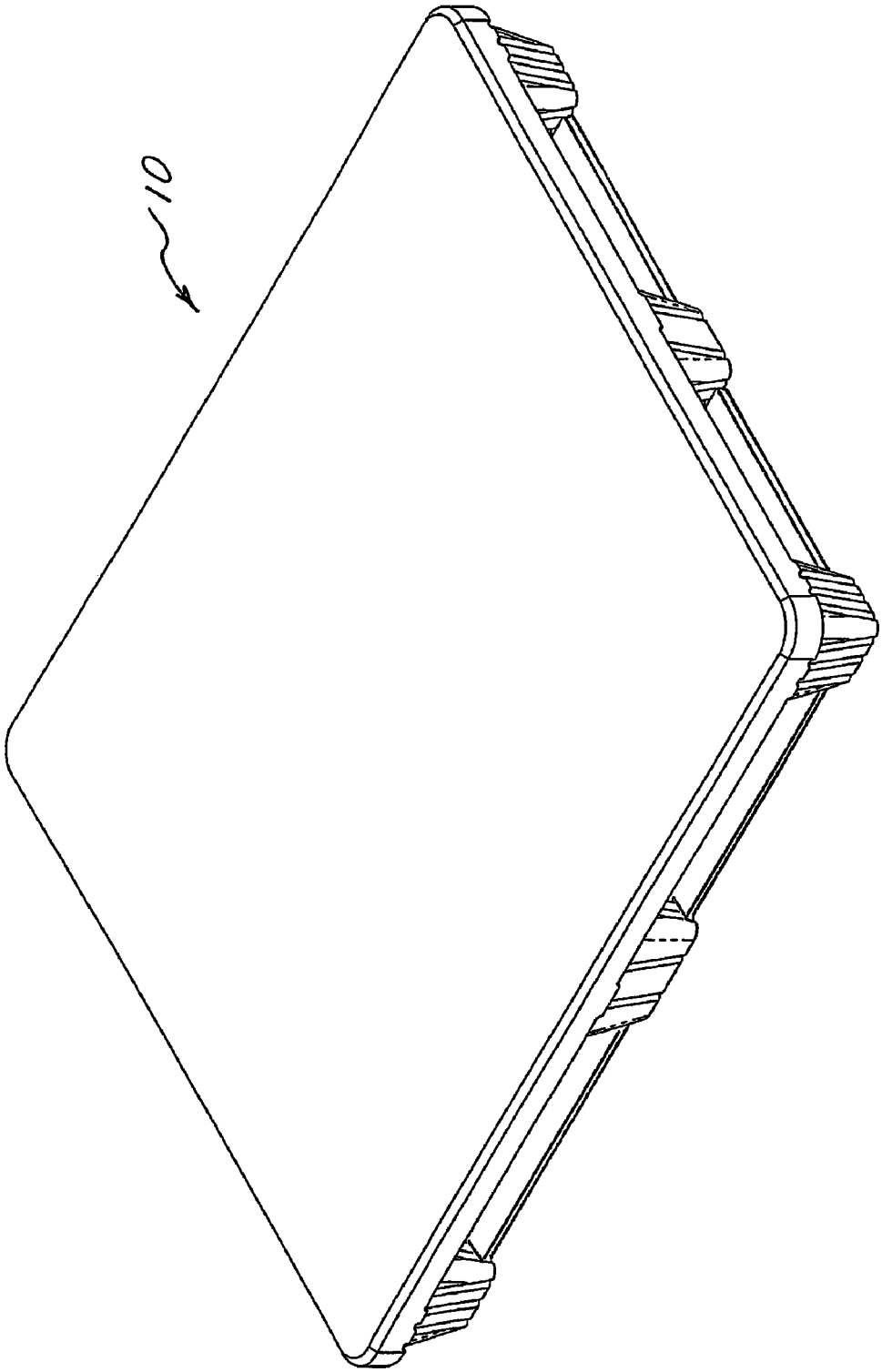
FIG. 1 is a top view of a four way entry, vacuum formed, rackable pallet that is constructed in accordance with the present invention and which includes a skin covered pallet body and an assembly of bridges.
Figure 2:
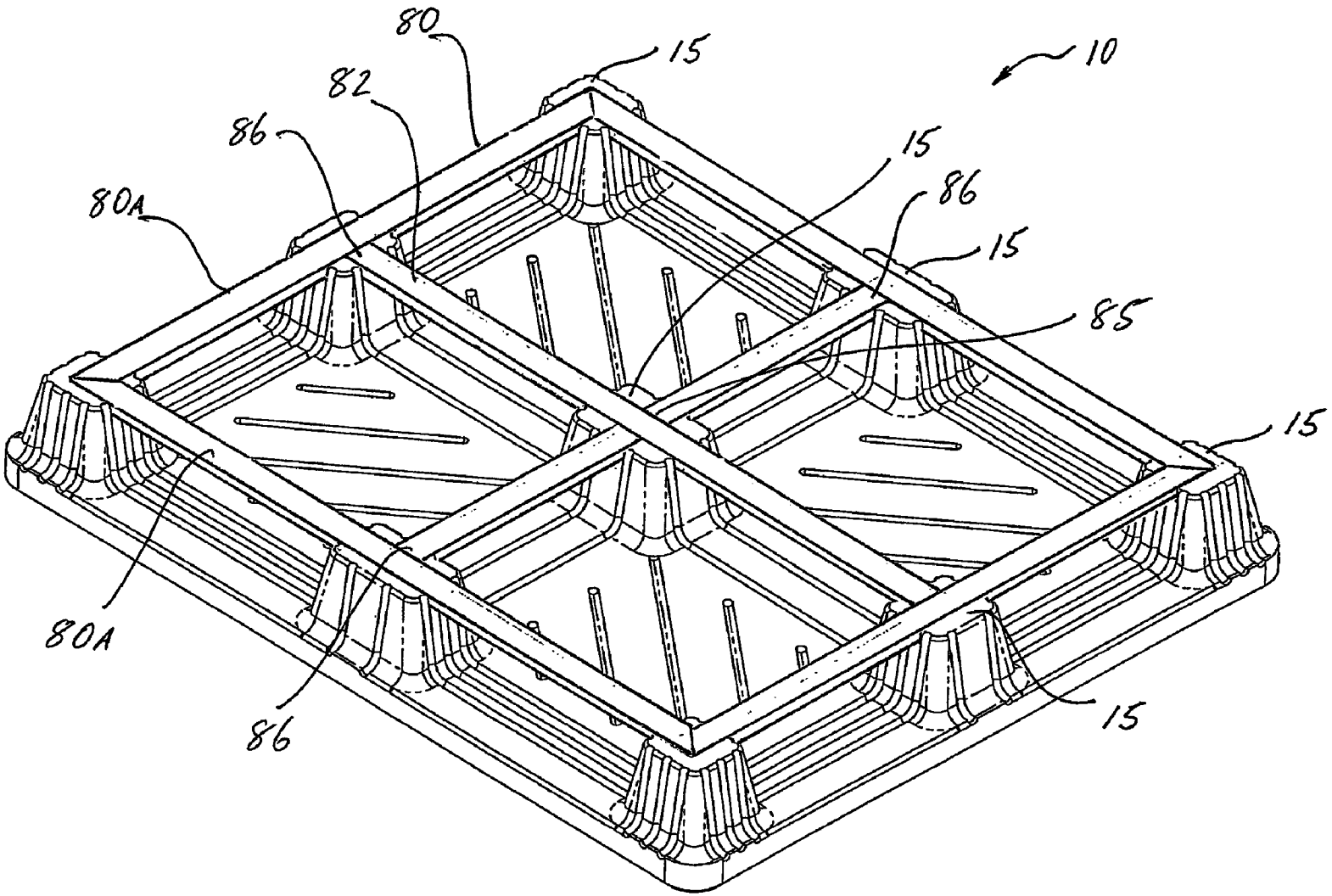
FIG. 2 is a bottom view of the pallet illustrated in FIG. 1.
Figure 4:
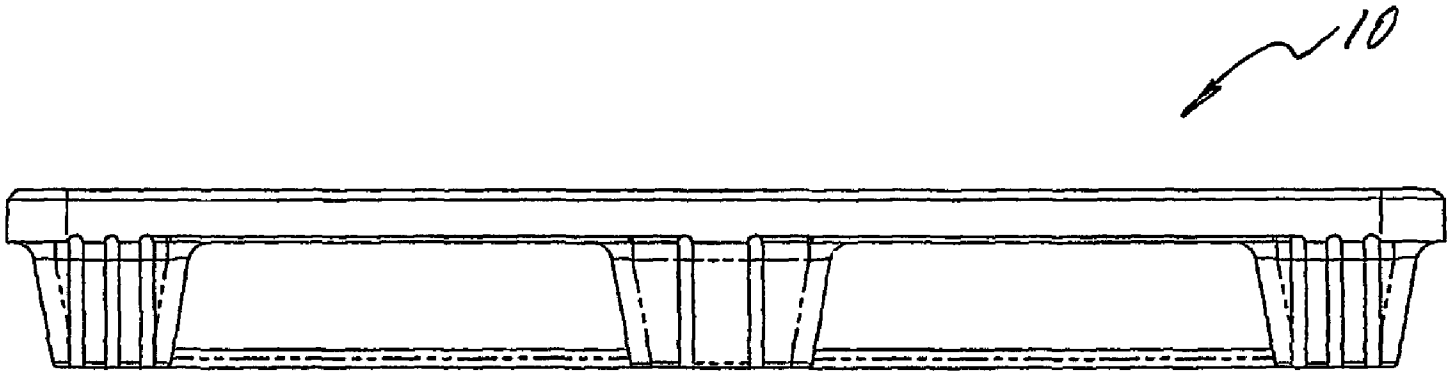
FIG. 4 is a side view of the pallet illustrated in FIG. 1.
Figure 3:
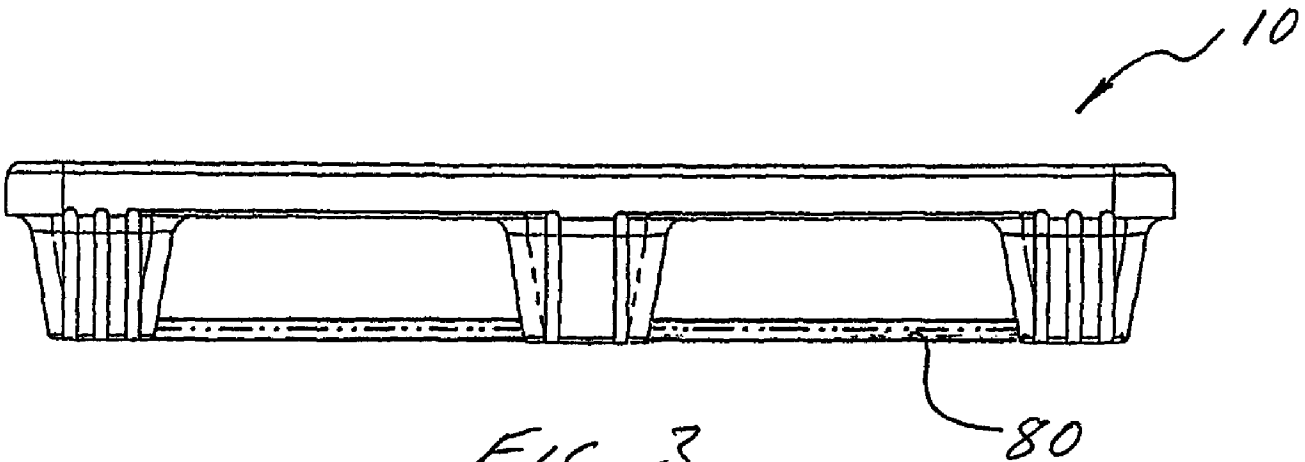
FIG. 3 is a front view of the pallet illustrated in FIG. 1.
Figure 5:
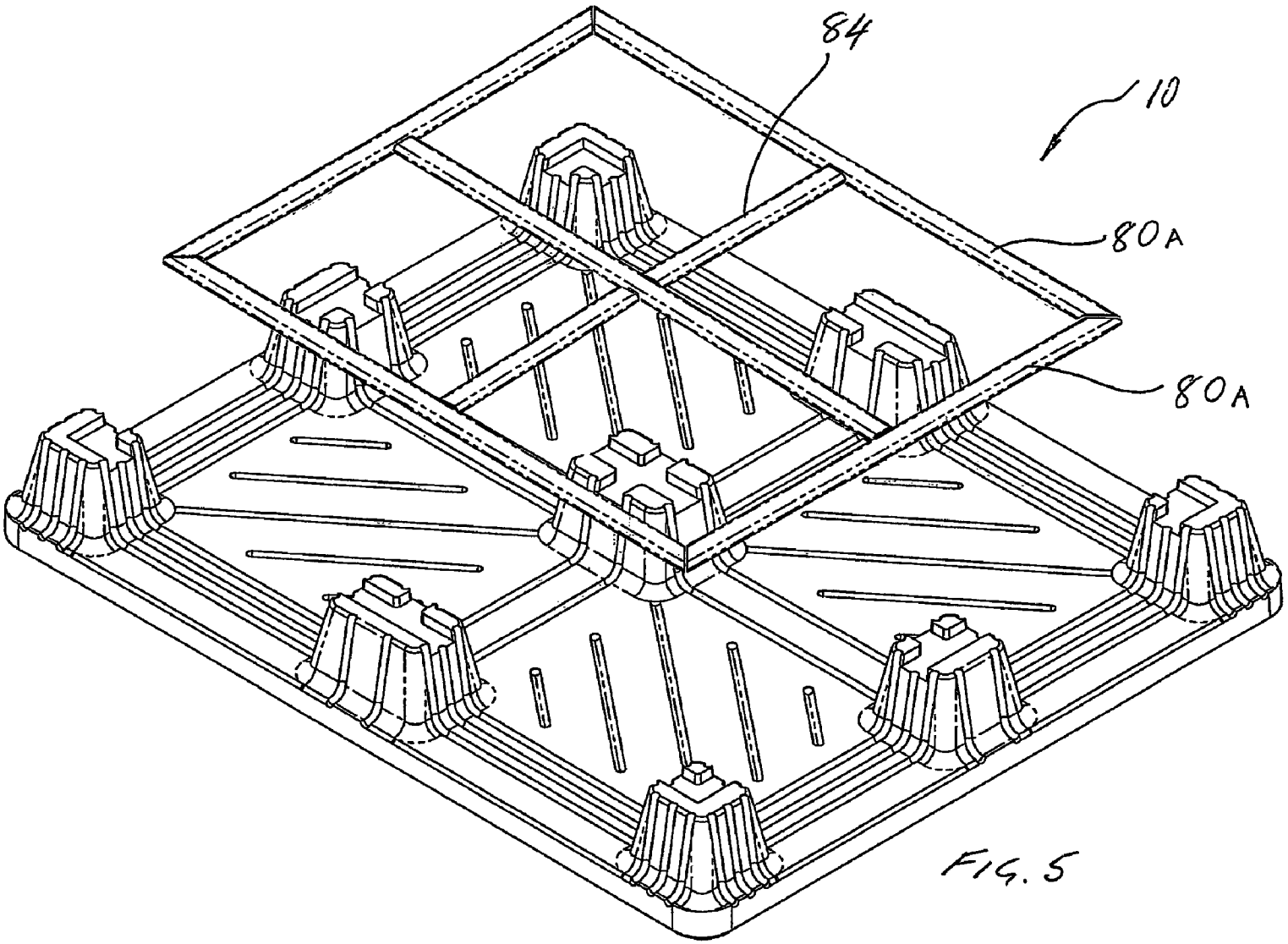
FIG. 5 is an exploded view showing the skin covered pallet body and the assembly of bridges apart and in line for assembly.
Figure 6:
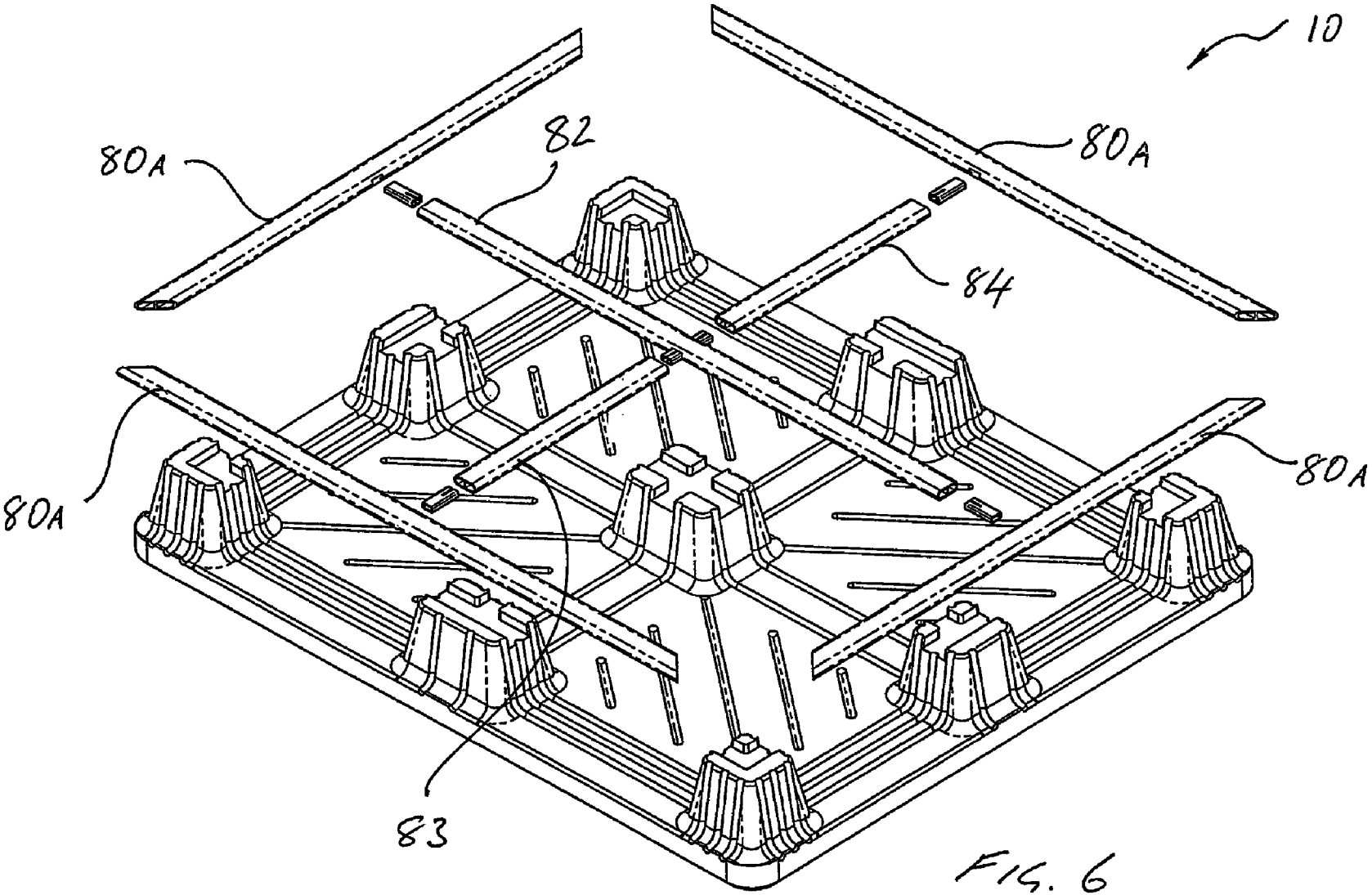
FIG. 6 is an exploded view showing the skin covered pallet body and the assembly of bridges, said assembly of bridges being shown apart and in line for assembly.
Figure 7:
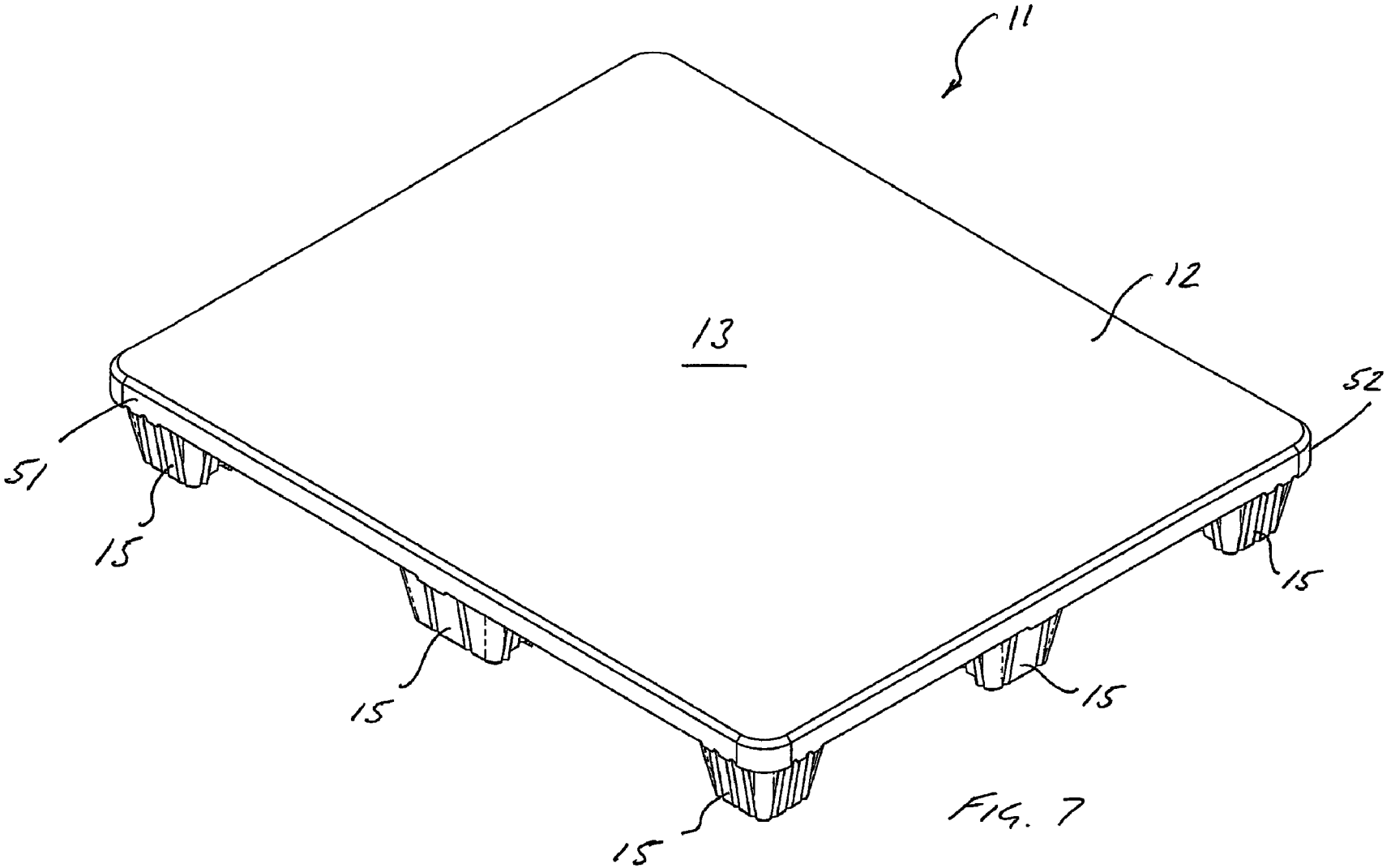
FIG. 7 is a top view of a foam body or blank that is constructed in accordance with the present invention and which is used in the manufacture of the pallet illustrated in FIG. 1.
Figure 8:
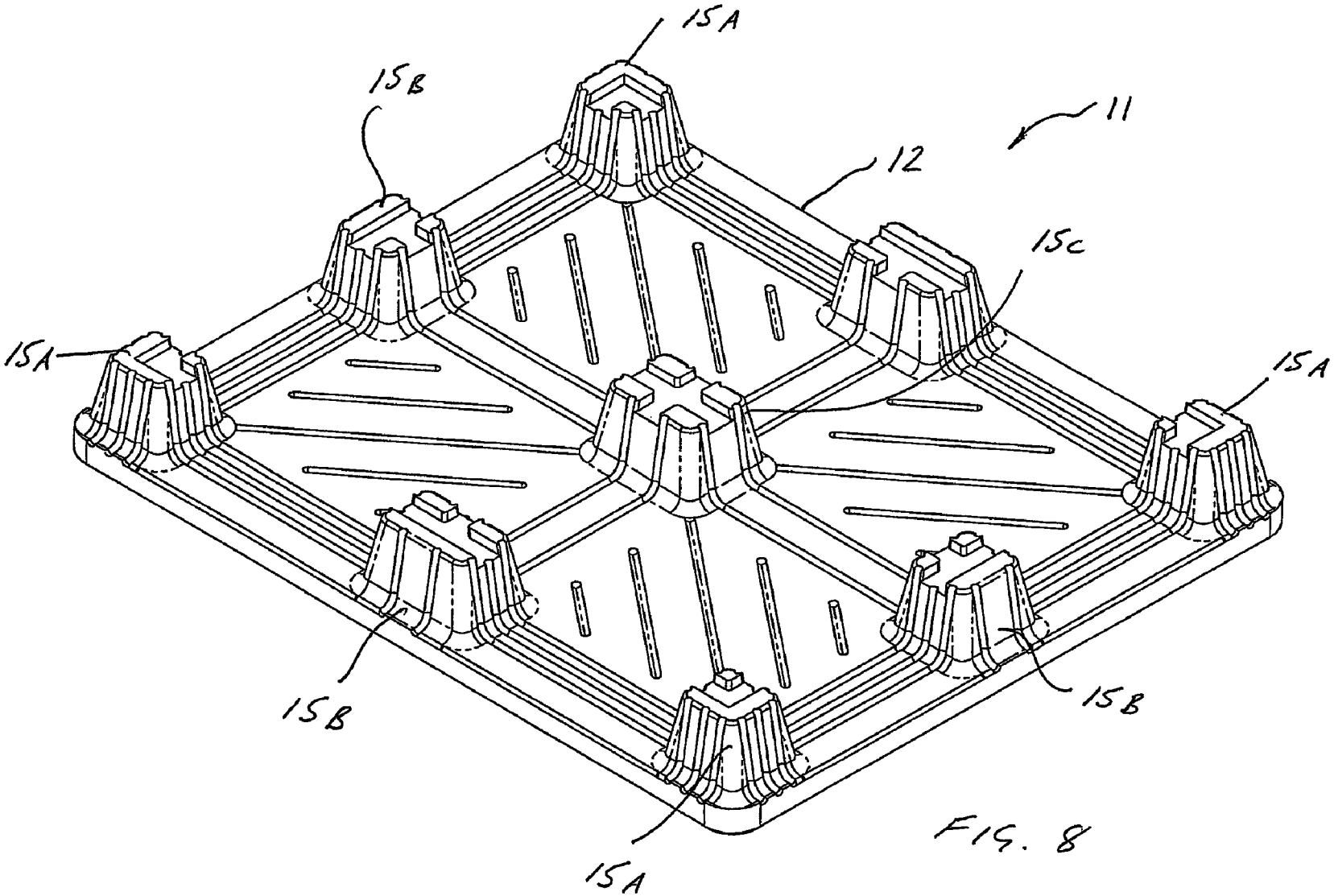
FIG. 8 is a bottom view of the foam blank illustrated in FIG. 7.
Figure 9:
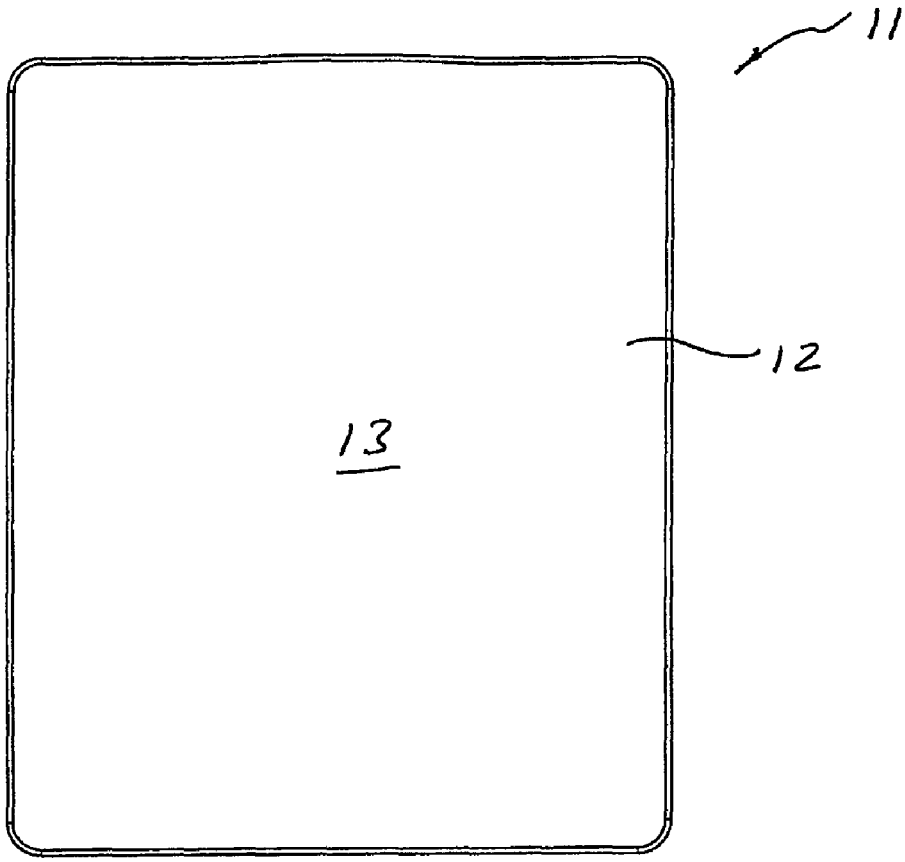
FIG. 9 is a top view of the foam blank illustrated in FIG. 7.
Figure 10:
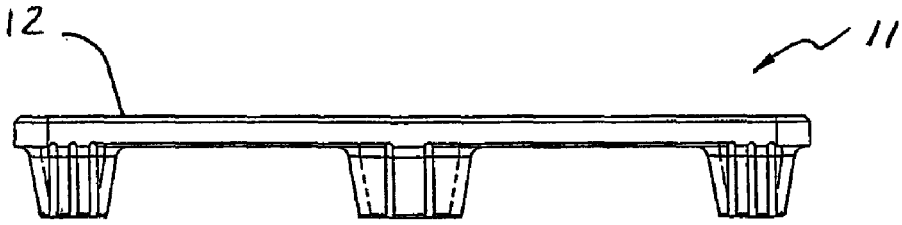
FIG. 10 is a side view of the foam blank illustrated in FIG. 7.
Figure 11:
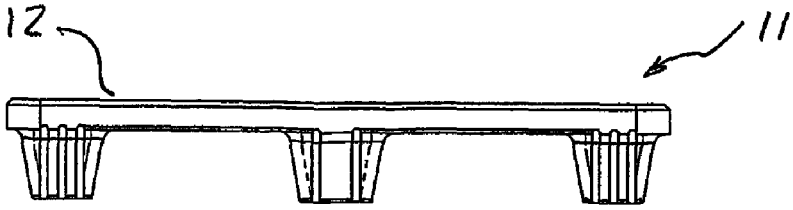
FIG. 11 is an end view of the foam blank illustrated in FIG. 7.
Figure 12:
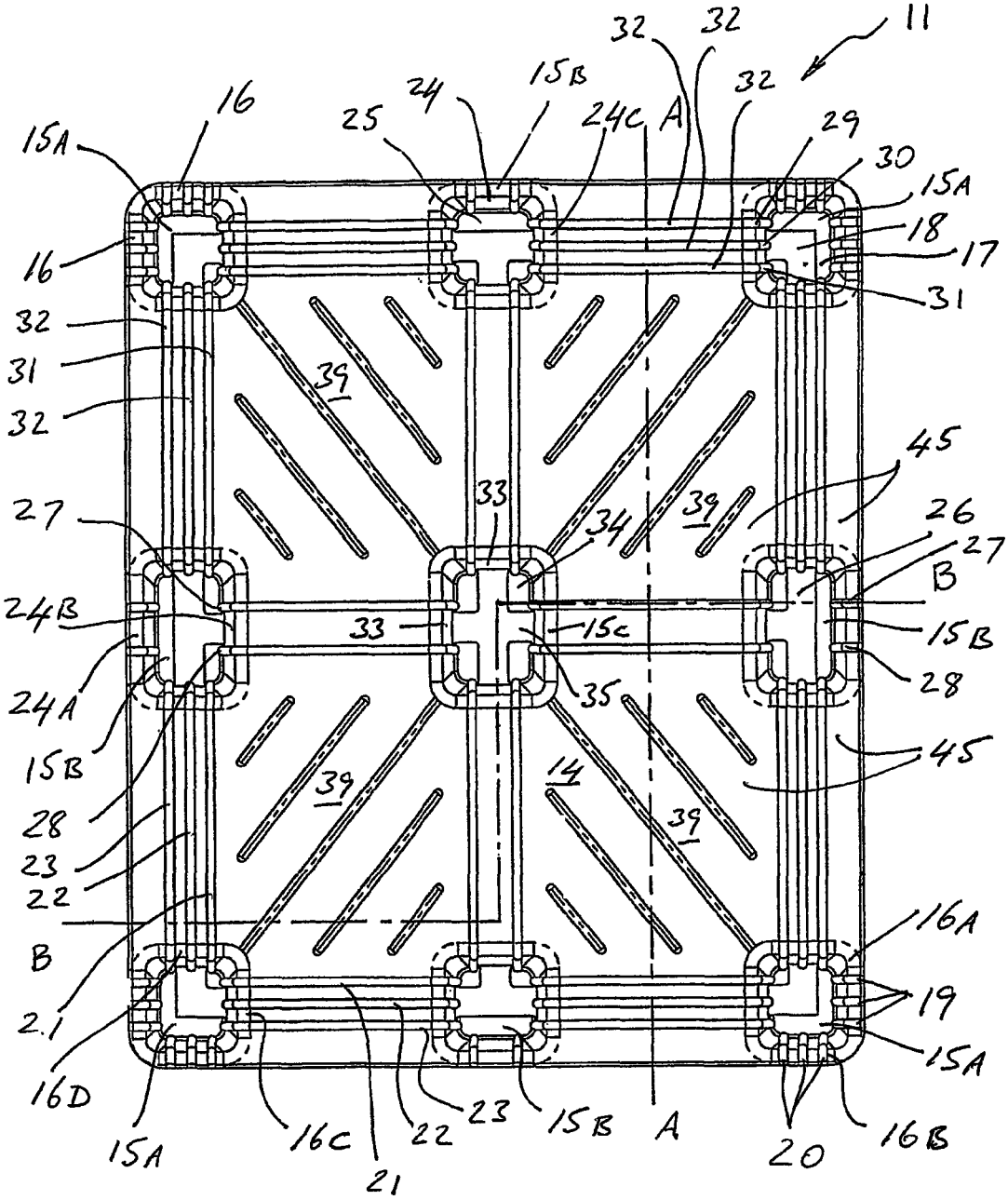
FIG. 12 is a bottom view of the foam blank illustrated in FIG. 7.
Figure 13:
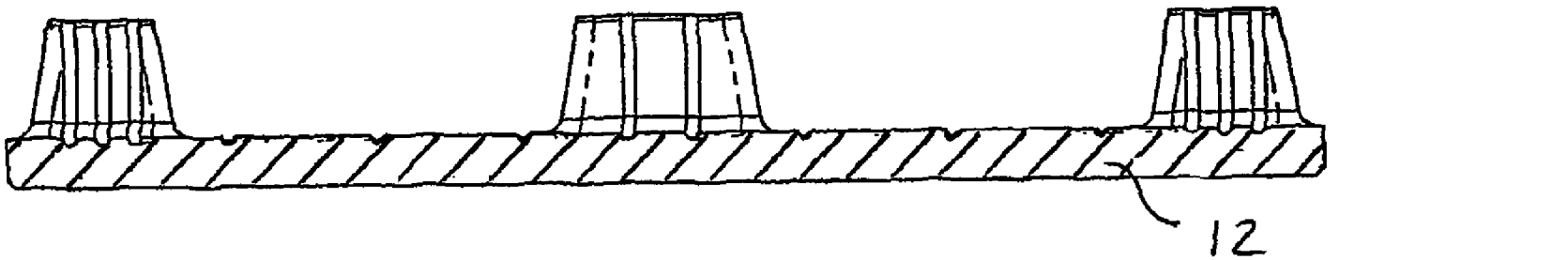
FIG. 13 is a cross-sectional view on AA of the foam blank illustrated in FIG. 7.
Figure 14:
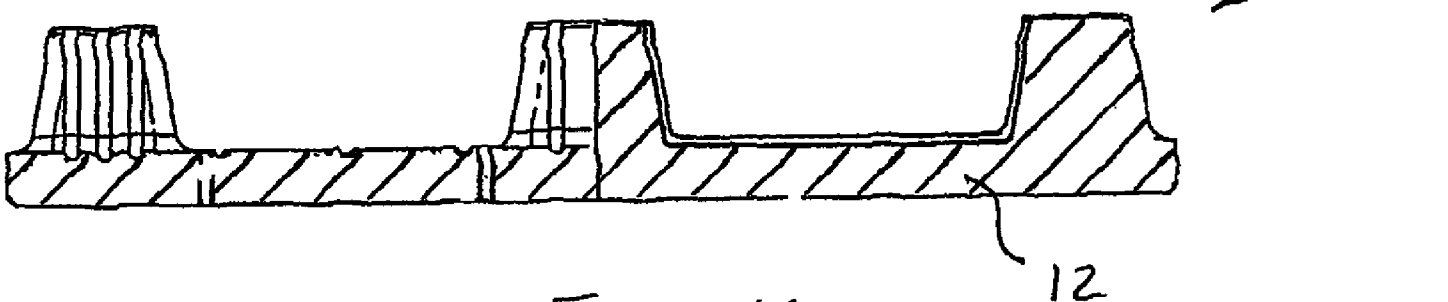
FIG. 14 is a cross-sectional view on BB of the foam blank illustrated in FIG. 7.
Figure 15:
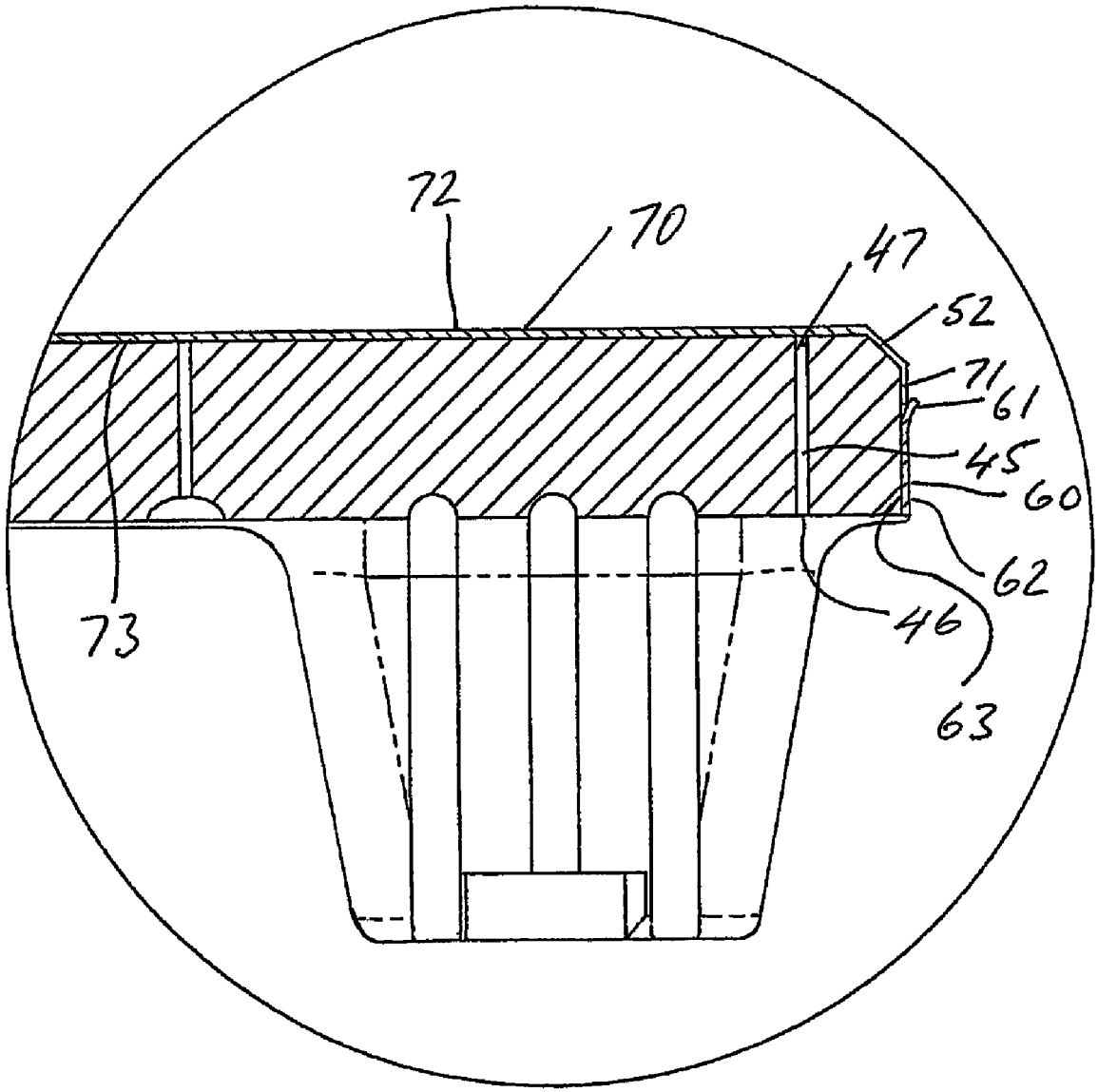
FIG. 15 is a detailed view from F of the foam blank illustrated in FIG. 7.

The pallet 10 includes a body or blank 11, see FIGS. 7 to 15, comprising a multitude of high impact polystyrene beads that are fused together. Preferably the body 11 is formed using a two part mould and wherein the density of the beads is approximately 28 Kg/m3 and the level of fusion is at least 70%.

The body 11 includes a platform 12, having a substantially square shaped, generally flat, upper side face 13 and an opposing underside face 14, and a plurality of supports 15 that depend from said underside face.

The supports 15 are arranged in rows that extend both transversely and longitudinally across the surface of the underside face 14. Further, the supports 15 include four corner supports 15*a* that depend from a respective corner of the platform 12 and which have a substantially square shaped transverse cross-section. The corner supports 15*a* each include two pairs of opposing, downwardly tapering, side walls 16 and an end wall 17 in which there is formed an aL@ shaped channel 18.

The outer facing side walls 16*a* and 16*b* of each corner support 15*a* include two grooves 19 and 20 respectively that are formed therein and which extend between the underside face 14 of the platform 12 and the end wall 17.

The inner facing side walls 16*c* and 16*d* of each corner support 15*a* include three grooves 21, 22 and 23 respectively that are formed therein and which extend between the underside face 14 of the platform 12 and the end wall 17.

The supports 15 include four middle supports 15*b* and wherein each middle support 15*b* is located midway between two corner supports 15*a*.

Each middle support 15*b* includes two pairs of opposing, downwardly tapering, side walls 24 and an end wall 25 in which there is formed a aT@ shaped channel 26. The outer facing side wall 24*a* and its opposing side wall 24*b* each include two grooves 27 and 28 respectively that are formed therein and which extend between the underside face 14 of the platform 12 and the end wall 25.

The other two side walls 24*c* and 24*d* each include three grooves 29, 30 and 31 respectively that are formed therein and which extend between the underside face 14 of the platform 12 and the end wall 25.

The grooves 28, 29 and 30 are connected to opposing grooves 21, 22 and 23 by three grooves 32 formed in the underside face 14 of the platform 12.

The supports 15 also include a central support 15*c* that depends from the centre of the platform 12. The support 15*c* has a substantially square shaped transverse cross-section and includes two pairs of opposing, downwardly tapering, side walls 33 and an end wall 34 in which there is formed a across@ shaped channel 35.

The side walls 33 each include two grooves 36 and 37 formed therein which extend between the underside face 14 of the platform 12 and the end wall 34. The grooves 36 and 37 are connected to an opposing pair of grooves 27 and 28 by two grooves 38 formed in the underside face 14 of the platform 12.

The grooves 38 divide the underside face 14 into essentially four quadrants 39 and wherein the underside face 14 of each quadrant 39 includes a series of five grooves 40 formed therein.

The platform 12 also includes a matrix of cavities or bores 45 that surround each of the supports 15. The bores are individually formed during the moulding process by a respective pin that is mounted on one part of the mould and wherein when the two parts of the mould are brought together, the pins extend into the mould cavity.

Each bore 45 includes an open end 46 that opens to the underside face 14 and an opposing closed end 47 that lies just below the surface of the upper side face 13. Further, the bores 45 are of substantially constant cross-section and, in the case of a pallet that is 1100 mm square, have a diameter of approximately 3 mm.

The platform 12 also includes two opposing pairs of side walls 51. Each side wall 51 is substantially rectangular in shape and includes a chamfered top edge portion 52.

The supports 15 and the underside face 14 of the body 11 are preferably covered by a generally rectangularly shaped bottom sheet 60 made of lead free PVC. The sheet 60 is preferably of substantially uniform thickness, approximately 1.2 mm, and has a peripheral edge portion 61. Further, the sheet 60 preferably has a substantially smooth outer face 62 and an opposing, substantially smooth, inner face 63.

During construction of the pallet 10, the pre-heated sheet 60 is brought in to contact with the end walls of the supports 15 and the peripheral edge portion 61 is clamped against abutting side walls 51 of the platform 12 using a tool or die, not shown. Then gases that are trapped between the sheet 60 and the underside face 14 are subsequently drawn through the body 11 thereby creating a partial vacuum between the underside face 14 and the sheet 60.

The forces created by the partial vacuum both urge and, where necessary, stretch the sheet such that it bears against and becomes bonded to the side walls of the supports 15 and the underside face 14 of the body 11.

It is believed that the bores 45, because they are located adjacent each of the supports 15, help ensure that the bottom sheet 60 bonds to the side walls of the supports 15 and those portions of the underside face 14 that are adjacent the supports 15.

The clamping of the sheet 60 against the side walls 51 causes the portions of the sheet that are in contact with the side walls to bond with same.

Preferably the manufacturing process involves the use of a tool that prevents the peripheral edge portion 61 of the sheet 60 from coming into contact with the side walls. Instead the peripheral edge portion 61 shall overlie yet diverge away from the side walls.

Finally those portions of the bottom sheet 60 that are covering the openings of the bores 45 are each pierced using a respective retractable pin.

The upper side face 13 of the body 11 is preferably covered by a generally rectangularly shaped top sheet 70 made of lead free PVC. The sheet 70 is preferably of substantially uniform thickness, approximately 0.6 mm, and has a peripheral edge portion 71. Further, the sheet 70 preferably has a substantially smooth outer face 72 and an opposing, substantially smooth, inner face 73.

During construction of the pallet 10, the pre-heated sheet 70 is supported above the body 11 by a tool that is adapted to hold the peripheral edge 74 of said sheet. The body 11 is then advanced such that the upper side face 13 makes contact with the inner face 73 of the sheet 70 and whereupon any gases trapped between said inner face and said upper side face are drawn through the body 11, aided by the inclusion of the bores 45. The resulting partial vacuum forces the sheet 70 against the upper side face 13 ensuring that as much of said sheet as possible will bond with said face.

The peripheral edge 74, when released by the tool holding same, is then folded over and pressed against the exposed portions of the side walls 51 of the body 11. Then, the peripheral edge portion 61 of the sheet 60 is folded over and heat bonded to the peripheral edge 74.

The pallet 10 also includes a plurality of bridges 80 that extend between adjacent supports 15, said bridges being spaced from the underside face of the platform by said support.

The bridges 80 are each formed from an extruded plastics material, such as lead free PVC, and comprise a hollow core that extends the length of the member and one or interconnecting webs.

The individual bridges 80 are adapted to be received in the various channels 18, 26 and 35 formed in the end walls 17, 25 and 34 respectively of the supports 15 and are preferably retained therein by friction and/or a suitable adhesive.

The peripheral bridges 80*a* are each provided with opposing mitred end portions 81. Abutting end portions 81 of adjacent bridges 80*a* are interconnected by a stake having opposing end portions that are frictionally retained within a respective bore.

The three internal bridges 82, 83 and 84 are preferably interconnected to one another where they meet at 85 and where the abut respective peripheral bridges 80*a* at 86 using a suitable connector.

Figure 16:
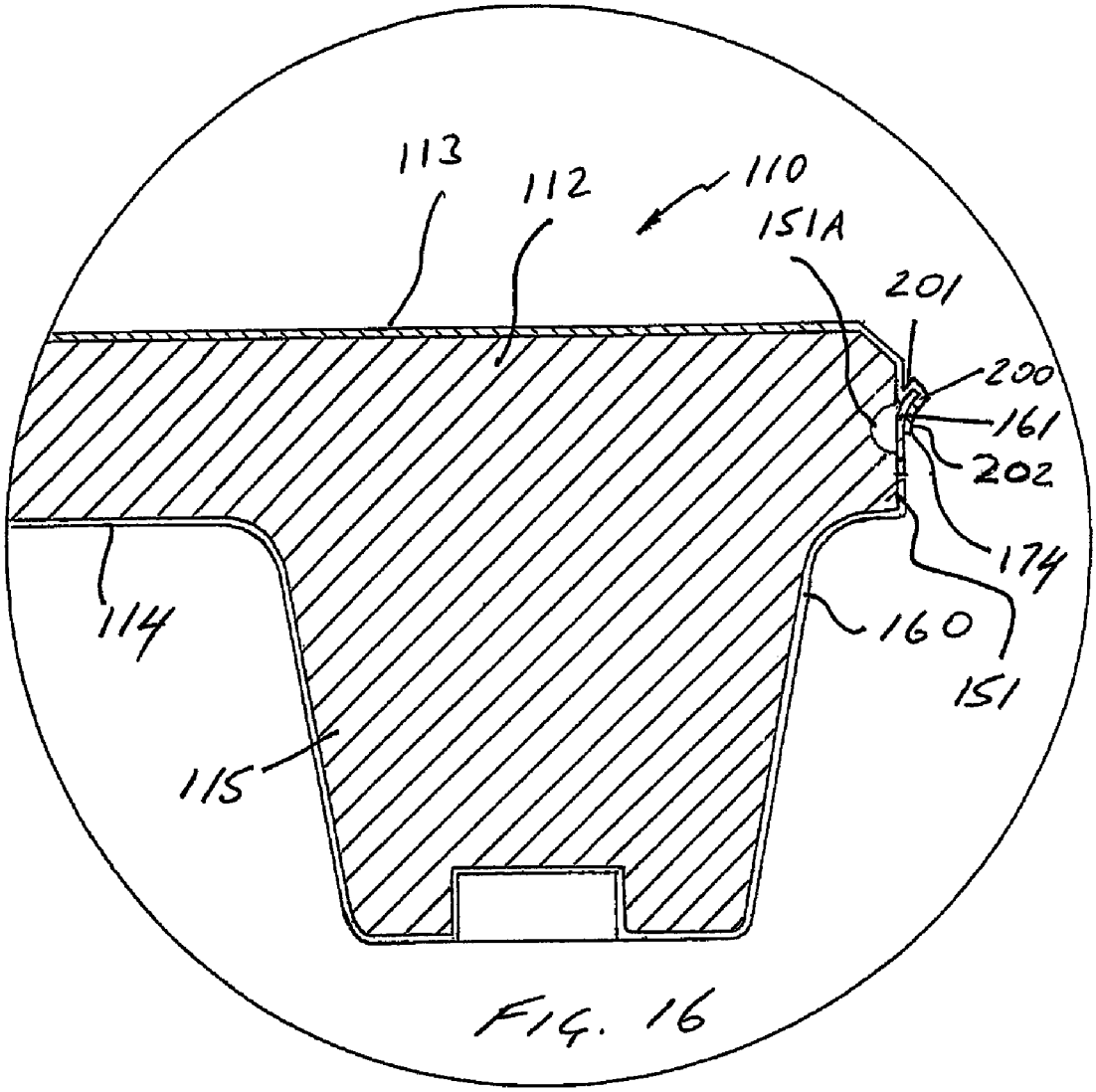
FIG. 16 is a cross-sectional view of an end portion of another pallet constructed in accordance with the present invention.

FIG. 16 shows a cross-sectional view of an end portion of a pallet 110 that is very similar to the pallet 10. The pallet 110 includes a body 111 comprising a multitude of high impact polystyrene beads that are fused together.

The body 111 includes a platform 112, having a substantially square shaped, generally flat, upper side face 113 and an opposing underside face 114, and a plurality of supports 115 that depend from said underside face. The supports 115 are arranged in rows that extend both longitudinally and transversely across the surface of the underside face 114.

The platform 112 also includes two opposing pairs of side walls 151. Each side wall 151 is substantially rectangular in shape and includes a groove 151*a* that has been formed either during the moulding process used to produce the body 111 or subsequently pressed into said side wall 151.

The supports 115 and the underside face 114 are covered by a generally rectangularly shaped sheet 160 made of lead free PVC and wherein the sheet 160 includes four peripheral edge portions 161.

During construction of the pallet 110, the pre-heated sheet 160 is brought into contact with the supports 115 and the peripheral edge portion 161 is clamped against abutting side walls 151 of the platform 112 using a tool, not shown. Then gases that are trapped between the sheet 160 and the underside face 114 are subsequently drawn through the body 111 thereby creating a partial vacuum between the underside face 114 and the sheet 160.

The forces created by the partial vacuum both urge and, where necessary, stretch the sheet such that it bears against and becomes bonded to the side walls of the supports 115 and the underside face 114 of the body 111.

The partial vacuum that is created also urges the sheet 160 to both conform to and bond with the side walls 151 of the platform 112, including the grooves 151*a*, but wherein a tool not shown prevents the peripheral edge portions 161 from making contact with the platform. Instead, the peripheral edge portions 161 each form a flap 200 that extends outwardly from the side walls 151 above the grooves 151*a* at an inclined angle, as shown in FIG. 16.

The upper side face 113 of the body 111 is preferably covered by a generally rectangularly shaped top sheet 170 also made from a lead free PVC and wherein the sheet includes four peripheral edge portions 171, each having a peripheral edge 174.

During construction of the pallet 110, the pre-heated sheet 170 is supported above the body 111 by a tool that is adapted to hold the peripheral edges 174 of said sheets. The body 111 is then advanced such that the upper side face 113 makes contact with the sheet 170 and whereupon any gases trapped between the sheet 170 and the upper side face 113 are drawn through the body 111. The resulting partial vacuum forces the sheet 170 against the upper side face 113 ensuring that as much of said sheet as possible bonds with said face.

Further, following trimming of the peripheral edges 174 of the sheet 170, the partial vacuum also forces the edge portions 171 to both conform to and bond with the side walls 151 such that they cover an upper side face 201 and a lower side face 202 of an adjacent flap 200, and wherein the tab 200 has a tendency to be drawn into an adjacent groove 151*a*, as shown in dotted outline.

It will be appreciated that the bridges 80 provide support for the pallet 10 when at least some of said bridges rest upon frame members of a rack.

Further, it will be appreciated that the bridges 80 do not prevent the location of forklift tines between the underside face of the platform 12 and opposing bridges, and between opposing rows of supports 15.

It will also be appreciated that the frame comprising a plurality of interconnected bridges 80 aids in preventing the splaying apart of the supports when heavy loads are placed on the pallet 10.

It is also believed that the addition of grooves formed in the outer side faces of the supports 15 will strengthen the pallet 10, and in particular the supports 15.

It has also been observed that the size of the load that may be supported by the pallets 10 and 110 is influenced by the size of the bearing area, namely the size of the surface area of the end walls 17, 25 and 34. The greater the bearing area the greater the load that the pallets can support.

In order to increase the bearing area and hence the load capacity of the pallets 10 and 110, it is proposed that the distance separating adjacent supports be minimized. However it is understood that the minimum distance separating adjacent supports must be sufficient to enable two adjacent tines of a forklift or similar lifting apparatus to each pass simultaneously between adjacent rows of supports 15 and 115.

Bearing the above in mind, it is proposed that the distance separating adjacent supports for most pallets be in the order of 80 mm.

It will of course be realised that while the foregoing description has been given by way of example of this invention, all other modifications and variations thereto as would be apparent to persons skilled in the art are deemed to fall within the broad scope and ambit of this invention as herein defined in the appended claims.

The claims defining the invention are as follows:

1. A rackable pallet having load bearing capabilities on which one or more articles may be placed for storage and/or transportation, including:

a body having a platform that includes an upper side face upon which the article or articles may rest and a plurality of supports that depend from an underside face of said platform, said supports being adapted to provide support for said platform and to space said platform above a foundation or a structure on which the pallet rests, said body being constructed from predominantly one or more light weight materials having no or little inherent load bearing capacity;

an external skin that is bonded to and envelopes the underside face of said platform and said supports and at least some of the upper side face of said platform, the external skin includes a first sheet that is vacuum formed onto and covers the underside face and the supports, the first sheet having a first peripheral edge portion, and a second sheet that is vacuum formed onto and covers the at least some of the upper side face, the second sheet having a second peripheral edge portion, the second peripheral edge is pressed against exposed portions of a side wall of the body, and the first peripheral edge portion is folded over and heat bonded to the second peripheral edge portion, and a plurality of bridges that extend between adjacent supports, said bridges being spaced from the underside of said platform and adapted to provide support for the pallet when at least some of said bridges rest upon frame members of a rack, and whereby in use a forklift having a plurality of tines may be used to move the pallet and wherein each tine may be locatable between adjacent supports and/or between the underside of said platform and one or more bridges.

2. A pallet as claimed in claim 1, wherein said supports are arranged in longitudinally and transversely extending rows.

3. A pallet as claimed in claim 2, wherein of said bridges each span two or more supports of a row.

4. A pallet as claimed in claim 1, wherein each of said supports includes a lower end wall and wherein said bridges are attached to said lower end walls.

5. A pallet as claimed in claim 1, wherein said body is constructed from expanded polystyrene (EPS).

6. A pallet as claimed in claim 5, wherein said expanded polystyrene has a density of approximately 28 kg/m3 and wherein the degree of fusion is at least 70%.

7. A pallet as claimed in claim 1, wherein the material from which said skin is made includes one or more of the following materials: acrylonitrite butadiene styrene: polyester; styrene; polycarbonate; PET; APET; PETG: lead free PVC; copolymer polyester/polycarbonate; and HDPE.

8. A pallet as claimed in claim 1, wherein said skin is manufactured from high impact polystyrene, (HIPS), or a composite HIPS structure and wherein said second sheet is approximately 0.6 mm thick and the first sheet is 1.2 mm thick.

9. A pallet as claimed in claim 1, wherein there is provided a plurality of cavities or openings formed in said body that extend between said upper side face of said platform and said underside face of said platform and/or between said upper side face of said platform and an underside face of said supports.

10. A pallet as claimed in claim 9, wherein said cavities are open to the underside face of said platform and extend through the body to a point just below said upper side face of said platform.

11. A pallet as claimed in claim 9, wherein said cavities have an internal diameter of approximately 3 mm.

12. A pallet as claimed in claim 1, wherein said bridges are manufactured from an extruded plastics material.

13. A pallet as claimed in claim 1, wherein said supports each include a plurality of side walls that are located between said underside face of said platform and an underside face of said support and wherein all of said side walls of at least some of said supports include a plurality of ribs that extend between said underside face of said platform and said underside face of said support.

14. A pallet as claimed in claim 1, wherein there is provided at least one groove or channel formed in said upper side face and wherein said groove or channel is adapted to receive a lower edge portion of a structural member or a side wall of a package that is adapted to surround one or more articles that are stored on said platform.

15. A pallet having load bearing capabilities on which one or more articles may be placed for storage and/or transportation, including:

a body having a platform that includes an upper side face upon which the article or articles may rest and a plurality of supports that depend from an underside face of said platform, said supports being adapted to provide support for said platform and to space said platform above a foundation or a structure on which the pallet rests, said body being constructed from predominantly one or more light weight materials having no or little inherent load bearing capacity;

an external skin that is bonded to and envelopes the underside face of said platform and said supports and at least some of the upper side face of said platform, the external skin includes a first sheet that is vacuum formed onto and covers the underside face and the supports, the first sheet having a first peripheral edge portion, and a second sheet that is vacuum formed onto and covers the at least some of the upper side face, the second sheet having a second peripheral edge portion, the second peripheral edge is pressed against exposed portions of a side wall of the body, and the first peripheral edge portion is folded over and heat bonded to the second peripheral edge portion, and a plurality of wear resistant members that are affixed to an underside of at least some of said supports and which are adapted in use to bear against a foundation upon which the pallet rests.

16. A pallet as claimed in claim 15, wherein said wear resistant members are bridges that extend between adjacent supports, said bridges being spaced from said underside of said platform and are adapted to provide support for the pallet when at least some of said bridges rest upon frame members of a rack.

17. A pallet having load bearing capabilities on which one or more articles may be placed for storage and/or transportation, including:

a body having a platform that includes an upper side face upon which the article or articles may rest and a plurality of supports that depend from an underside face of said platform, said supports being adapted to provide support for said platform and to space said platform above a foundation or a structure on which the pallet rests, said body being constructed from predominantly one or more light weight materials having no or little inherent load bearing capacity;

an external skin that is bonded to and envelopes the underside face of said platform and said supports and at least some of the upper side face of said platform, the external skin includes a first sheet that is vacuum formed onto and covers the underside face and the supports, the first sheet having a first peripheral edge portion, and a second sheet that is vacuum formed onto and covers the at least some of the upper side face, the second sheet having a second peripheral edge portion, the second peripheral edge is pressed against exposed portions of a side wall of the body, and the first peripheral edge portion is folded over and heat bonded to the second peripheral edge portion, and a plurality of surface projections that depend from a lower face of at least some of said supports, said projections being adapted to engage a foundation, such as a conveyor.

18. A pallet as claimed in claim 17, wherein the engagement of said projections with the foundation is an interlocking engagement.

19. A pallet as claimed in claim 17, wherein the pallet includes one or more foundation engaging members and wherein said surface projections are associated with said foundation engaging member or said foundation engaging members, and wherein the foundation engaging member or each foundation engaging member is attached to one or more supports.

20. A pallet as claimed in claim 19, wherein the pallet is a rackable pallet and wherein each of said foundation engaging members are bridges that extend between adjacent supports, said bridges being spaced from said underside of said platform and are adapted to provide support for the pallet when at least some of said bridges rest upon frame members of a rack.

21. A pallet formed using a vacuum forming process, said pallet having load bearing capabilities and on which one or more articles may be placed for storage and/or transportation, said pallet including:

a body having a platform that includes an upper side face upon which the article or articles may rest and a plurality of supports that depend from an underside face of said platform, said supports being adapted to provide support for said platform and to space said platform above a foundation or a structure on which the pallet rests, said body being constructed from expanded polystyrene, and an external skin that is bonded to and envelopes the underside face of said platform and said supports and at least some of the upper side face of said platform, the external skin includes a first sheet that is vacuum formed onto and covers the underside face and the supports, the first sheet having a first peripheral edge portion, and a second sheet that is vacuum formed onto and covers the at least some of the upper side face, the second sheet having a second peripheral edge portion, the second peripheral edge is pressed against exposed portions of a side wall of the body, and the first peripheral edge portion is folded over and heat bonded to the second peripheral edge portion, wherein there are formed a plurality of cavities and/or openings in said body.

22. A pallet as claimed in claim 21, wherein said cavities are open to the underside face of said platform and extend through the body to a point just below said upper side face of said platform.

23. A pallet as claimed in claim 21, wherein said cavities have an internal diameter of approximately 3 mm.

24. A pallet formed using a vacuum forming process, said pallet having load bearing capabilities and on which one or more articles may be placed for storage and/or transportation, said pallet including:

a body having a platform that includes an upper side face upon which the article or articles may rest and a plurality of supports that depend from an underside face of said platform, said supports being adapted to provide support for said platform and to space said platform above a foundation or a structure on which the pallet rests, said body being constructed from expanded polystyrene, and an external skin that is bonded to and envelopes the underside face of said platform and said supports and at least some of the upper side face of said platform, the external skin includes a first sheet that is vacuum formed onto and covers the underside face and the supports, the first sheet having a first peripheral edge portion, and a second sheet that is vacuum formed onto and covers the at least some of the upper side face, the second sheet having a second peripheral edge portion, the second peripheral edge is pressed against exposed portions of a side wall of the body, and the first peripheral edge portion is folded over and heat bonded to the second peripheral edge portion, wherein each of said supports includes a plurality of side walls located between the underside of said platform and an end wall of said support and wherein all of said side walls of at least some of said supports include a plurality of ribs that extend between the underside of said platform and said end wall.

25. A pallet as claimed in claim 24, wherein the pallet also includes a plurality of bridges that extend between adjacent supports, said bridges being spaced from said underside of said platform and adapted to provide support for said pallet when at least some of said bridges rest upon frame members of a rack, and whereby in use a forklift having a plurality of tines may be used to move the pallet and wherein each tine may be locatable between adjacent supports and/or between said underside of said platform and one or more of said bridges.

* * * * *

US007908979C1

(12) EX PARTE REEXAMINATION CERTIFICATE (9743rd)

United States Patent
Yoshida et al.

(10) Number: US 7,908,979 C1
(45) Certificate Issued: Jul. 11, 2013

(54) PALLET HAVING LOAD BEARING CAPABILITIES ON WHICH ARTICLES MAY BE PLACED FOR STORAGE AND/OR TRANSPORTATION

(75) Inventors: Zane Yoshida, Yeronga (AU); Rene Roger Lloyd Doel, Helensvale (AU); Chee Cheang Lee, Penang (MY)

(73) Assignee: Aeropal Technology SDN. BHD, Bukit Mertajam, Penang (MY)

Reexamination Request:
No. 90/009,976, Dec. 14, 2011

Reexamination Certificate for:

| | |
|---|---|
| Patent No.: | **7,908,979** |
| Issued: | **Mar. 22, 2011** |
| Appl. No.: | **12/094,031** |
| Filed: | **May 16, 2008** |

(21) Appl. No.: 90/009,976

(22) PCT Filed: Nov. 17, 2006

(86) PCT No.: PCT/AU2006/001734

§ 371 (c)(1), (2), (4) Date: May 16, 2008

(87) PCT Pub. No.: WO2007/056821

PCT Pub. Date: May 24, 2007

(30) Foreign Application Priority Data

Nov. 17, 2005 (AU) ..... 2005906379

(51) Int. Cl.
*B65D 19/38* (2006.01)

(52) U.S. Cl.
USPC ..... 108/57.25; 108/57.27

(58) Field of Classification Search
None
See application file for complete search history.

(56) References Cited

To view the complete listing of prior art documents cited during the proceeding for Reexamination Control Number 90/009,976, please refer to the USPTO's public Patent Application Information Retrieval (PAIR) system under the Display References tab.

*Primary Examiner* — Aaron J Lewis

(57) ABSTRACT

A pallet includes a platform, having a substantially rectangular shape and is generally flat, an upper side face and an opposing underside face, and a plurality of supports that depend from said underside face. The supports are arranged in rows that extend both transversely and longitudinally across the surface of the underside face. The supports and the underside face are preferably covered by a generally rectangular shaped bottom sheet made, for example, of high impact polystyrene (HIPS) or high-density polyethylene (HDPE). A top sheet covers at least some of the upper side face. The supports are interconnected by a plurality of bridges that are spaced from the underside of the platform and which are adapted to provide support for the pallet when at least some of said bridges rest upon frame members of a rack.

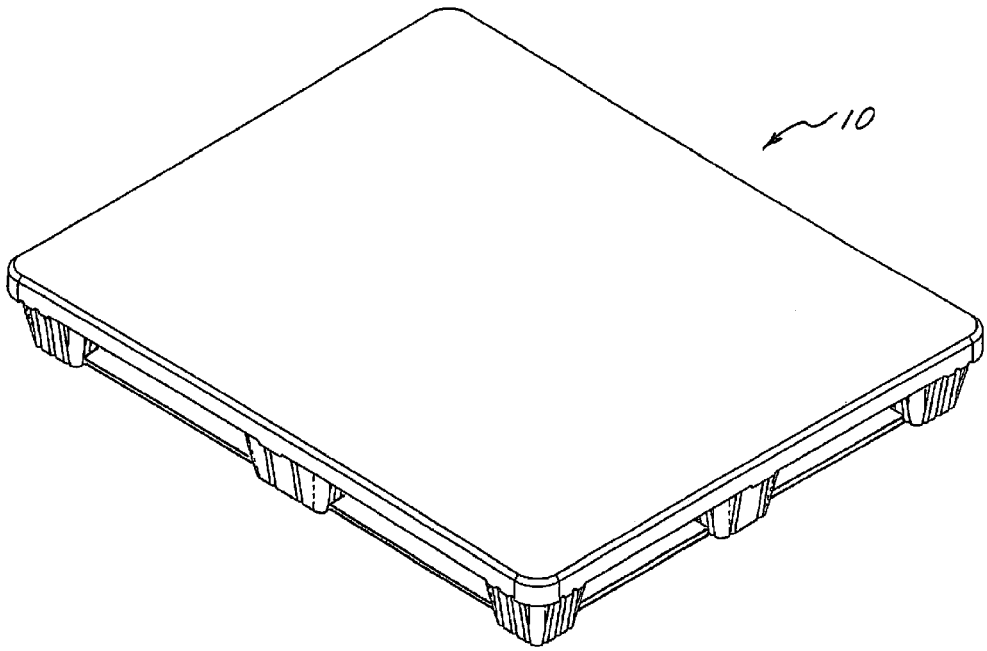

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claim 1 is confirmed.

Claims 15, 17, 21 and 24 are cancelled.

Claims 2-14, 16, 18-20, 22, 23 and 25 were not reexamined.

* * * * *